US006035922A

United States Patent [19]

Sugitani et al.

[11] Patent Number: 6,035,922

[45] Date of Patent: Mar. 14, 2000

[54] METHOD FOR MANUFACTURING A CASTING AND APPARATUS THEREFOR

[75] Inventors: Nobuhiro Sugitani, Tokyo; Shoichi Makimoto, Osaka, both of Japan

[73] Assignees: Sugitani Kinzoku Kogyo Kabushiki Kaisha, Tokyo; Toyo Aluminium Kabushiki Kaisha, Osaka, both of Japan

[21] Appl. No.: 09/101,660

[22] PCT Filed: Nov. 13, 1997

[86] PCT No.: PCT/JP97/04139

§ 371 Date: Nov. 10, 1998

§ 102(e) Date: Nov. 10, 1998

[87] PCT Pub. No.: WO98/20999

PCT Pub. Date: May 22, 1998

[30] Foreign Application Priority Data

Nov. 14, 1996 [JP] Japan ..... 8-316911

[51] Int. Cl.[7] ..... B22D 18/06

[52] U.S. Cl. ..... 164/65; 164/133; 164/254

[58] Field of Search ..... 164/63, 65, 133, 164/254, 113, 119, 306

[56] References Cited

U.S. PATENT DOCUMENTS 3,905,415 9/1975 Lefebvre ..... 164/113

FOREIGN PATENT DOCUMENTS 57-206562 12/1982 Japan ..... 164/306

OTHER PUBLICATIONS

Search Report from European Patent Office dated Jan. 4, 1999.

*Primary Examiner*—Kuang Y. Lin

*Attorney, Agent, or Firm*—Pitney, Hardin, Kipp and Szuch LLP

[57] ABSTRACT

To provide an apparatus for manufacturing a casting, in which sealing can be formed between joint surfaces of a mold without using any packing material. An apparatus for manufacturing a casting comprising a mold split into at least two mold parts designed so as to define a cavity, an introduction port provided at one end of the mold for introducing molten metal into the cavity, and an exhaust port provided at the other end of the mold for exhausting air in the cavity; characterized by further comprising a groove which is provided around a portion defining the cavity in at least one of joint surfaces of the at least two mold parts so as to connect the introduction port to the exhaust port.

8 Claims, 5 Drawing Sheets

METHOD FOR MANUFACTURING A CASTING AND APPARATUS THEREFOR

TECHNICAL FIELD

The present invention relates to a method of manufacturing a casting by using a split mold split into at least two mold parts and an apparatus therefor.

BACKGROUND ART

As for a conventional apparatus for manufacturing a casting, a single part production has been carried out by using a two-part mold. That is, while the temperature of joined mold parts is kept within a range near the upper limit of the solid-solution phase temperature of an aluminum alloy, inorganic particles are charged into a cavity in the mold. The pressure in the cavity of the mold is reduced by vacuum-suction from one end of the cavity, while molten metal of the aluminum alloy at the liquid phase temperature is suction-injected from the other end into fine gaps among the particles in the inorganic particle layers in the cavity so that a composite member having predetermined dimensions is manufactured.

However, it is difficult to keep sealing between joint surfaces of the joined mold parts. Particularly when the temperature of the mold is high as mentioned above, a gap may be produced between the joint surfaces of the mold because of the warp of the mold caused by a temperature difference between the mold temperature and the outside air temperature. Accordingly, it becomes further difficult to keep the sealing between the joint surfaces of the mold. Therefore, reduction of pressure in the cavity cannot be attained when the pressure in the cavity is reduced by vacuum-suction after inorganic particles are charged into the cavity of the joined mold, so that molten metal cannot be suction-injected into the joined mold.

To attain the reduction of pressure in the cavity of the mold at the time of vacuum-suction, a heat-resistant packing may be attached to the joint surfaces of the mold. However, there is no suitable packing material which can keep a desired vacuum at such a high temperature. Even if metal packing material which can be proof against high temperature is used, it is inferior in durability. Particularly in a mold of the type in which opening and closing are repeated, the sealing between the joint surfaces of the mold is lost when the elasticity of the metal packing material is lost, and the effect of packing is therefore lost.

It is an object of the present invention to provide a method of manufacturing a casting and an apparatus therefor, in which joint surfaces of mold can be sealed without using any packing material.

DISCLOSURE OF THE INVENTION

In order to achieve the above object, according to Claim 1, provided is a method of manufacturing a casting comprising a step of defining a cavity for manufacturing a casting by a mold split into at least two mold parts, and a step of exhausting air in the cavity while introducing molten metal into the cavity; characterized by further comprising a step of forming sealing between respective joint surfaces of the mold parts by introducing a portion of the molten metal, which is introduced into the cavity, onto the joint surfaces when the molten metal is introduced into the cavity.

According to the method of manufacturing a casting stated in Claim 1, when molten metal is introduced into a cavity defined by a mold split into at least two mold parts, a part of the molten metal to be introduced is introduced to the joint surfaces of the mold. The molten metal introduced to the joint surfaces air-tightly blocks the cavity in the mold from the outside of the mold. As a result, it is possible to attain the sealing between the joint surfaces of the mold effectively without using any packing material.

In order to achieve the above object, according to Claim 2, provided is an apparatus for manufacturing a casting comprising a mold split into at least two mold parts designed so as to define a cavity, an introduction port provided at one end of the mold for introducing molten metal into the cavity, and an exhaust port provided at the other end of the mold for exhausting air in the cavity; characterized by further comprising a groove which is provided around a portion defining the cavity in at least one of joint surfaces of the at least two mold parts so as to connect the introduction port to the exhaust port;

The apparatus for manufacturing a casting stated in Claim 2 has a groove which is formed in at least one of the respective joint surfaces of the two-part mold so as to extend around a defined portion of the cavity, and so as to be connected to an introduction port through which molten metal is introduced into the cavity. Accordingly, at the time of introducing the molten metal into the cavity, the cavity and the groove are closed by the molten metal in the introduction port in a condition that the molten metal fills only the introduction port while it does not reach the cavity. Therefore, the air existing in the cavity and the groove is exhausted out of an exhaust port surely. At this time, the groove filled with the molten metal air-tightly blocks the cavity from the outside of the mold. Accordingly, it is possible to effectively attain sealing between the joint surfaces of the mold without using any packing material.

According to Claim 3, the above apparatus for manufacturing a casting is characterized in that the mold split into at least two mold parts is configured so that inorganic particles are stored in the cavity.

According to the apparatus for manufacturing a casting stated in Claim 3, inorganic particles are charged into the cavity. Accordingly, the flow path resistance of the molten metal in the groove is smaller than that in the cavity, so that the groove can be surely filled with the molten metal prior to the cavity when the molten metal is introduced into the introduction port. It is therefore possible to improve the effect of the sealing between the joint surfaces of the mold.

According to claim 4, the above apparatus for manufacturing a casting according to Claim 2 or 3 is characterized in that a vacuum application means is connected to the exhaust port.

According to the apparatus for manufacturing a casting stated in Claim 4, it is possible to manufacture a thin composite member.

According to Claim 5, the above apparatus for manufacturing a casting according to any one of Claims 2 to 4 is characterized in that a heat-resistant mesh member is attached to the exhaust port.

According to the apparatus for manufacturing a casting stated in Claim 5, it is possible to prevent the molten metal flowing in the groove from flowing to the exhaust port.

THE BEST MODE FOR CARRYING OUT THE INVENTION

Figure 1:
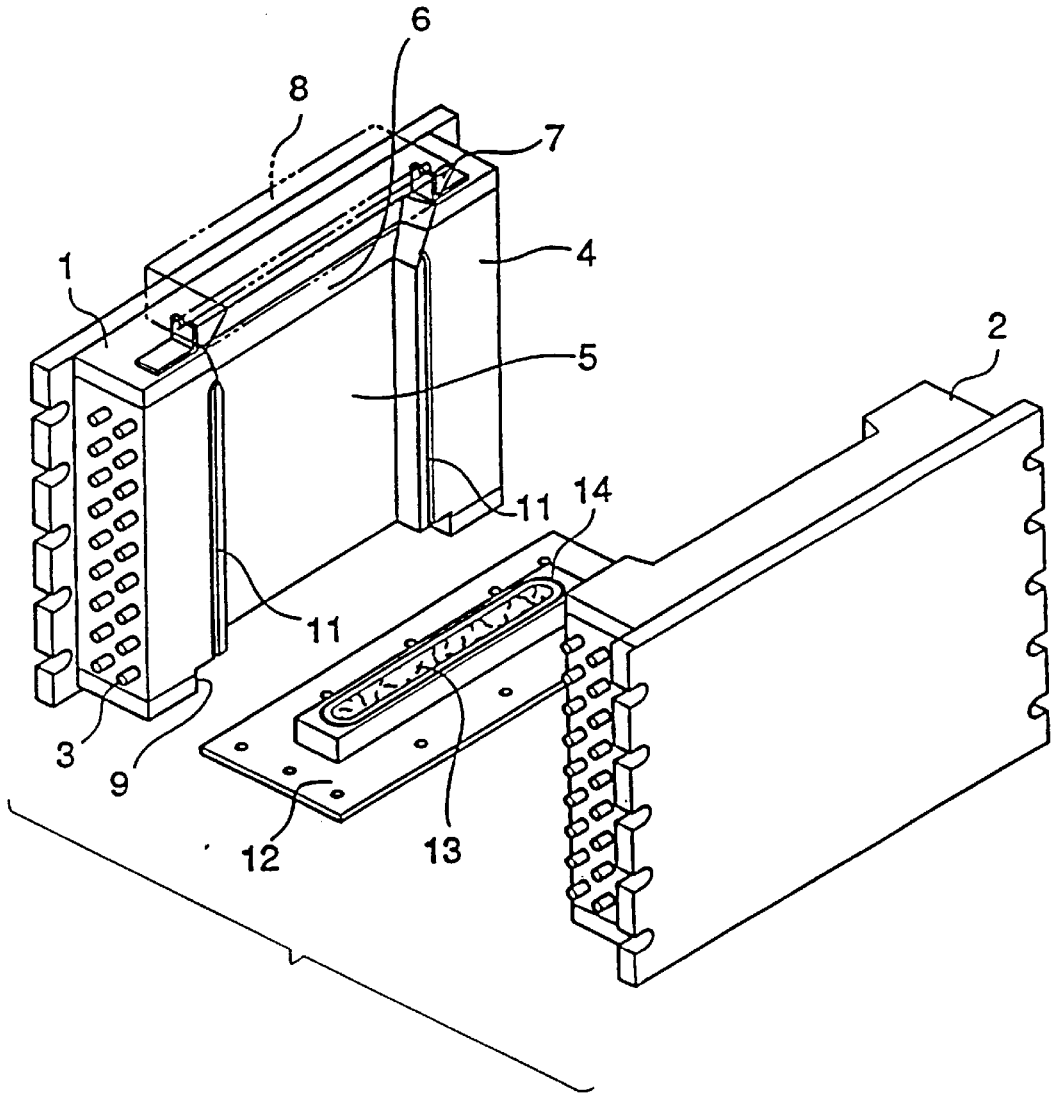
FIG. 1 is an exploded perspective view of an apparatus for manufacturing a casting according to a first mode for carrying out the present invention.

The present invention will be described in detail below with reference to the preferred embodiment shown in the drawings.

Figure 2:
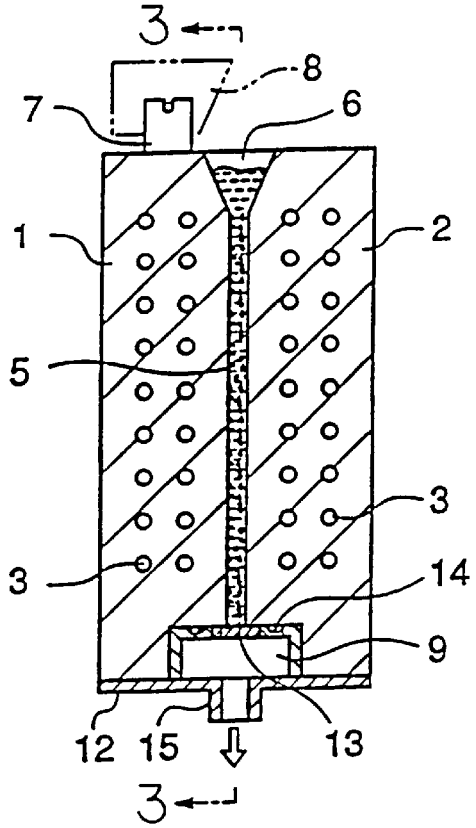
FIG. 2 is a sectional view taken on line A—A in FIG. 3.
Figure 3:
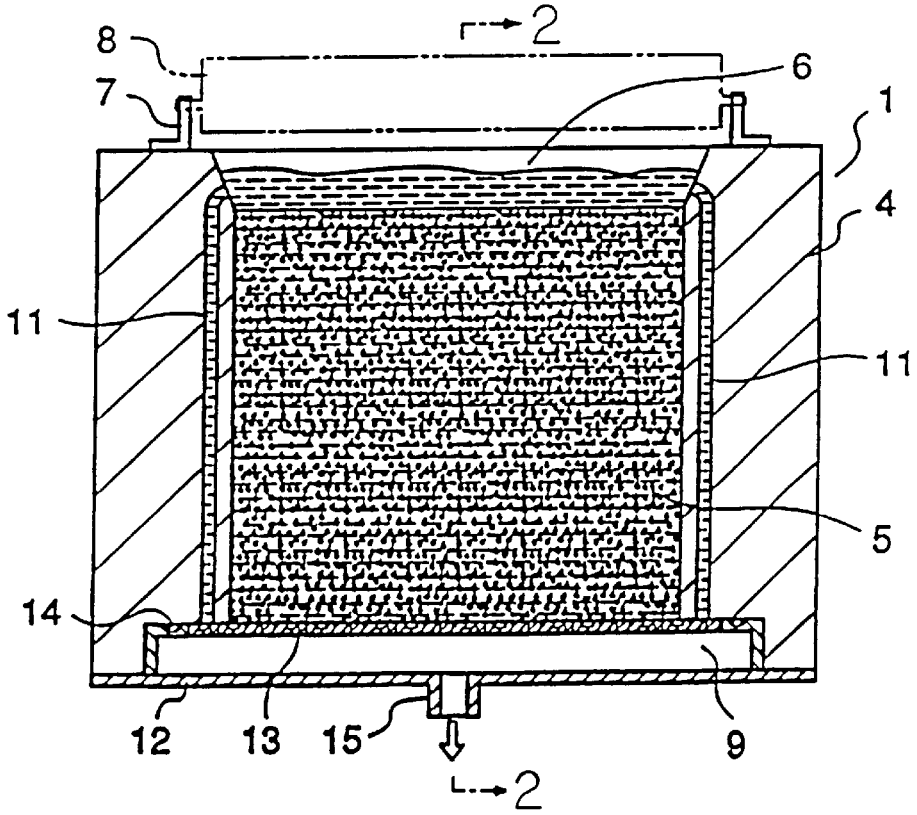
FIG. 3 is a sectional view taken on line B—B in FIG. 2.

FIG. 1 is an exploded perspective view of an apparatus for manufacturing a casting according to a first embodiment of the represent invention. FIG. 2 is a sectional view taken on line A—A in FIG. 3. FIG. 3 is a sectional view taken on line B—B in FIG. 2.

The apparatus for manufacturing a casting according to this first embodiment is constituted by mold parts 1 and 2 of a two-part mold joined by a plurality of tie rods (not shown). Nine stages in total of U-shaped electric heaters 3 are buried in each of the mold parts 1 and 2, so that the mold parts 1 and 2 can be heated uniformly. The respective heaters 3 are controlled to be preset temperature by not-shown temperature sensors and a controller.

A cavity 5 about 480 mm long, about 470 wide and 6 mm thick is defined in a joint surface 4 of each of the-mold parts 1 and 2. In the upper portion of each of the mold parts 1 and 2, a tapered teeming port 6 is formed over the length corresponding to the cavity 5 as an introduction port the cross-sectional area of which is reduced as a position goes downward. The upper end of the cavity 5 is connected to the lower end of the teeming port 6. The dimensions of the cavity 5 is not limited to those mentioned above. In addition, the mold parts 1 and 2 are configured so that inorganic particles which will be described later are stored in the cavity 5.

A pair of ladle support members 7 are attached to the upper surface of the mold part 1, and a ladle 8 filled with molten metal is rotatably supported by the ladle support members 7. By inclining the ladle 8, the molten metal in the ladle 8 is poured into the teeming port 6.

In addition, in the lower portion of each of the mold parts 1 and 2, a rectangular recess portion 9 opened downward is formed as an exhaust port over the length corresponding to the cavity 5. The lower end of the cavity 5 is connected to the upper end of the recess portion 9.

In the joint surface 4 of the mold part 1, grooves 11 are formed at a distance of about 10 mm outside from the opposite sides of the portion defined as the cavity 5. Each of the grooves 11 has a semi-circular or rectangular section, and the width is about 6 to 10 mm. In addition, each groove 11 is opened to the teeming port 6 and the recess portion 9. In addition, the grooves 11 may be provided in the mold part 2, or the grooves 11 may be formed in each of the mold parts 1 and 2.

A suction box 12 is attached to the recess portions 9. The suction box 12 is urged upward by a not-shown air cylinder so as to be pressed against the lower surfaces of the mold parts 1 and 2. In the upper portion of the suction box 12, an opening portion is provided over a range including the cavities 5 and the grooves 11. A heat-resistant mesh member 13 is mounted in this opening portion in a suitable manner. The mesh member 13 is formed of heat-resistant alumina fibers with gaps of 30 to 70 micron mesh. In addition, a groove is provided in the upper surface of the suction box 12 so as to surround the opening portion. A packing 14 is attached to this groove.

A suction port 15 is provided in the lower portion of the suction box 12. This suction port 15 is connected to a not-shown vacuum generation unit as a vacuum application means.

The operation of the apparatus for manufacturing a casting according to this first embodiment will be described below with reference to FIGS. 1 to 3.

First, the mold parts 1 and 2 are joined with each other as shown in FIG. 2, and the temperature of the mold parts 1 and 2 is kept within a range near the upper limit of solid-solution temperature of an aluminum alloy by the electric heaters 3. The suction box 12 is attached into the recess portion 9 by a not-shown air cylinder, and the lower end opening of the cavity 5 and the lower end openings of the grooves 11 are closed by the mesh member 13. Next, inorganic particles are introduced into the cavity 5 through the teeming port 6. Then, the vacuum generation unit is actuated to reduce the pressure in the cavity 5.

Successively, the ladle 8 is inclined to pour molten metal into the teeming port 6 (see FIG. 3). At this time,in a condition that the molten metal fills only the teeming port 6 but it does not reach the cavity 5, the upper end openings of the cavity 5 and grooves 11 are closed by the molten metal in the teeming port 6. Therefore, the air existing in the cavity 5 and the grooves 11 is sucked by the vacuum generation unit through the suction box 12. Then, because the cavity 5 is filled with the inorganic particles, the flow path resistance of the molten metal in the grooves 11 is much smaller than that in the cavity 5. Therefore, first, the grooves 11 are filled with the molten metal. By the action of the mesh member 13, there is no fear that the molten metal flowing in the grooves 11 flows into the suction box 12.

The grooves 11 filled with the molten metal air-tightly block the cavity 5 from the outside of the mold parts 1 and 2 so as to attain sealing between the joint surfaces 4 of the mold parts 1 and 2 effectively. As a result, the vacuum in the cavity 5 is kept, so that the molten metal in the teeming port 6 is poured surely into fine gaps among particles in inorganic particle layers in the cavity 5. Then, the preset temperature of the mold parts 1 and 2 is changed into a range near the lower limit of the solid-solution temperature of an aluminum alloy to thereby solidify the molten metal poured into the fine gaps among the particles in the inorganic particle layers in the cavity 5. Next, the air cylinder is actuated to remove the suction box 12 from the recess portion 9. The mold parts 1 and 2 are opened, and a solidified composite member is released and taken out from the cavity 5.

Although molten metal is poured into the cavity 5 through the teeming port 6 after inorganic particles are introduced into the cavity 5 in the mold parts 1 and 2 in the first embodiment, an effect similar to that in the first embodiment can be obtained even in the case where the molten metal is poured into the cavity 5 through the teeming port 6 without introducing the inorganic particles into the cavity 5. In this case, the shape of the teeming port 6 is formed such that the molten metal poured into the teeming port 5 flows into the grooves 11 before it flows into the cavity 5. That is, the teeming port 6 is formed in the portion near the two grooves 11 so as to be deeper by 30 mm or more than the portion near the cavity 5 to thereby provide a groove teeming port portion. Further, the pouring port of the ladle 8 is divided into two branches so that the molten metal is poured into the groove teeming port portion. Consequently, the molten metal poured into the groove teeming port portion fills the grooves 11 first, and then the molten metal overflowing from the groove teeming port portion flows into the cavity 5.

Figure 4:
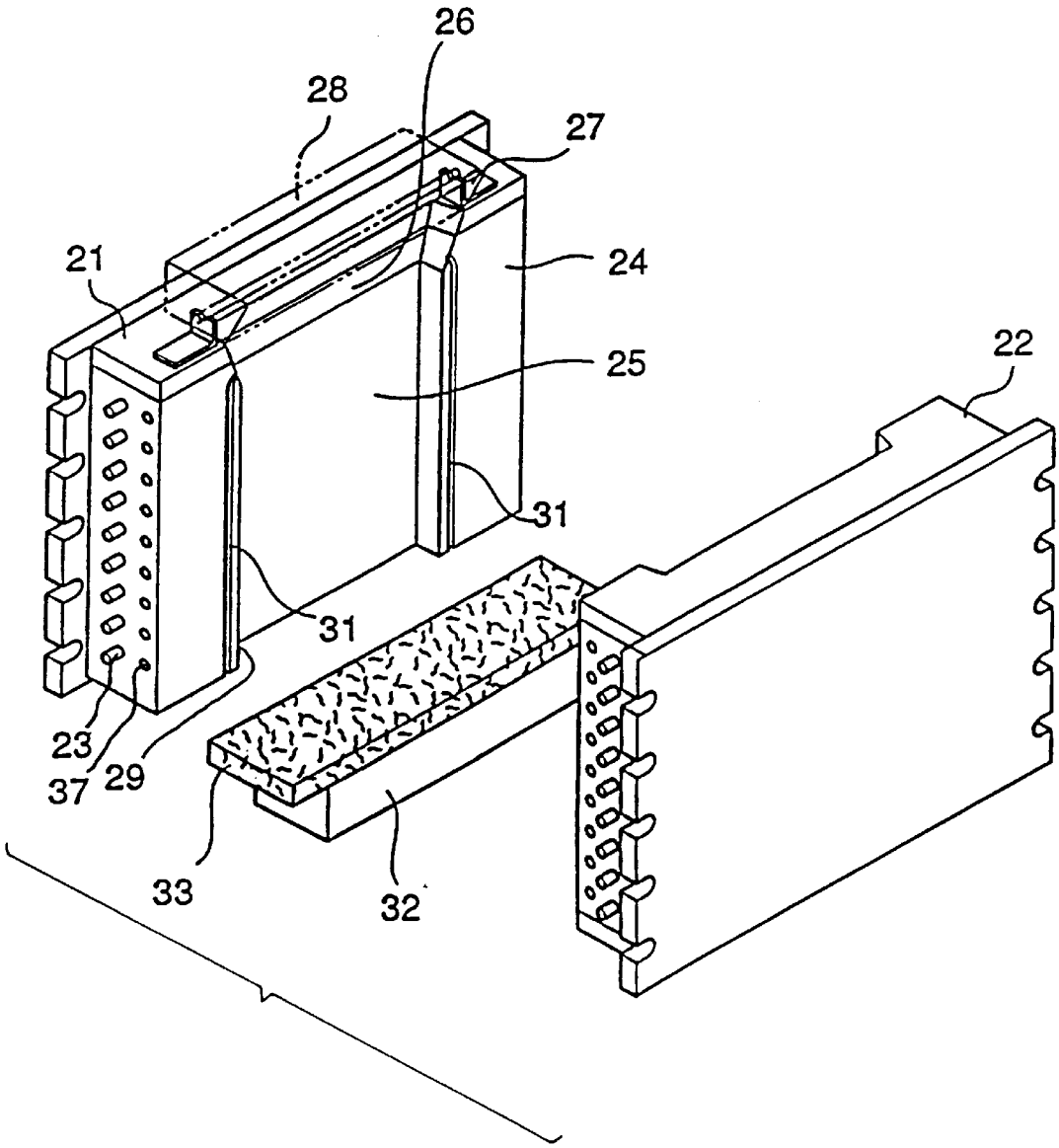
FIG. 4 is an exploded perspective view of an apparatus for manufacturing a casting according to a second mode for carrying out the present invention.
Figure 5:
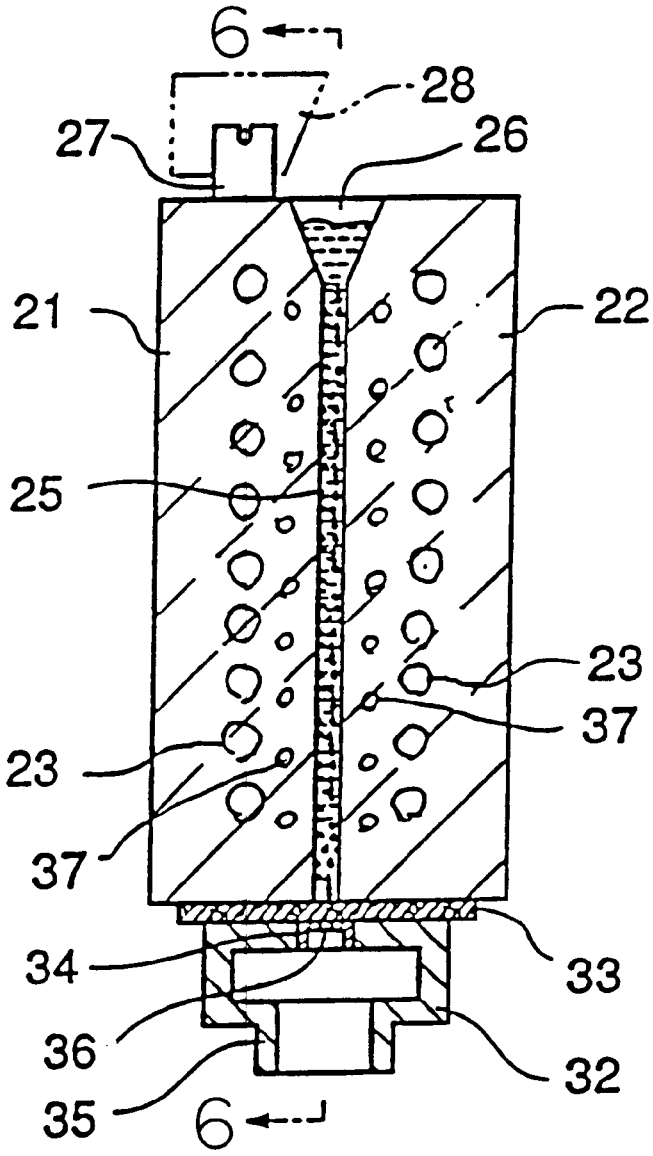
FIG. 5 is a sectional view taken on line C—C in FIG. 6.
Figure 6:
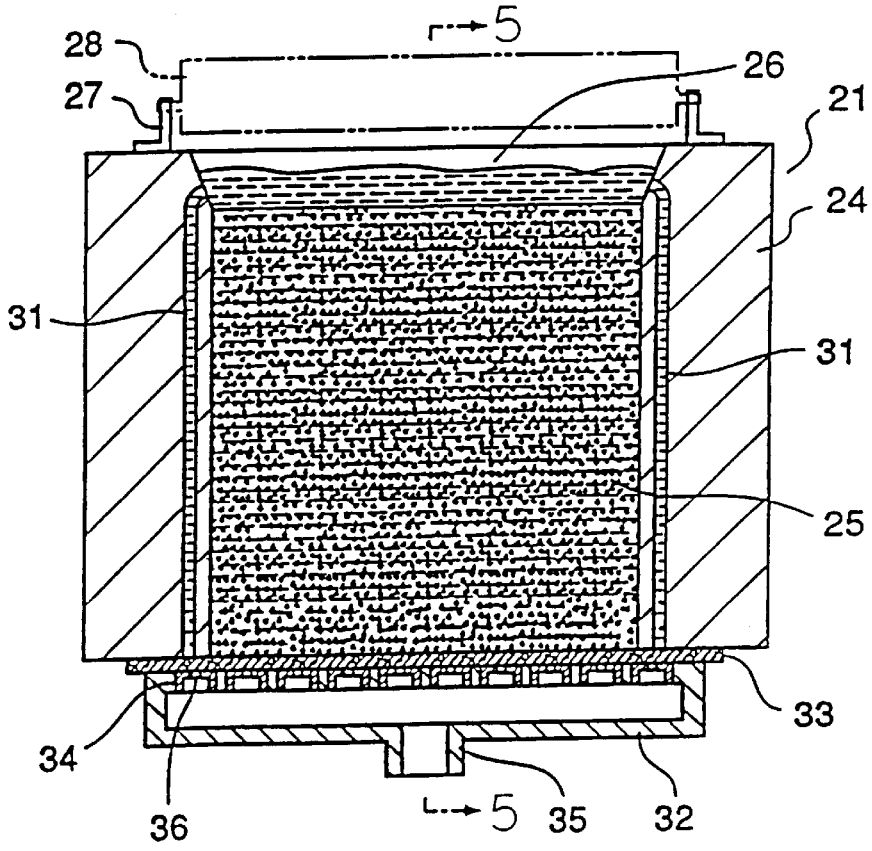
FIG. 6 is a sectional view taken on line D—D in FIG. 5.

FIG. 4 is an exploded perspective view of an apparatus for manufacturing a casting according to a second embodiment of the present invention. FIG. 5 is a sectional view taken on line C—C in FIG. 6. FIG. 6 is a sectional view taken on line D—D in FIG. 5.

The apparatus for manufacturing a casting according to this second embodiment is constituted by mold parts 21 and 22 of a two-part mold joined by a plurality of tie rods (not shown). Nine stages in total of electric heaters 23 are buried in each of the mold parts 21 and 22. In addition, individual temperature sensors 37 are buried near the respective heaters 23. The temperature sensors 37 are connected to a not-shown controller. With such a configuration, the mold parts 21 and 22 can be heated to preset temperature uniformly.

A cavity 25 about 600 mm long, about 600 wide and 6 mm thick is defined in a joint surface 24 of each of the mold parts 21 and 22. In the upper portion of each of the mold parts 21 and 22, a tapered teeming port 26 is formed over the horizontal length of the cavity 25 as an introduction port the cross-sectional area of which is reduced as a position goes downward. The upper end of the cavity 25 is connected to the lower end of the teeming port 26. The dimensions of the cavity 25 is not limited to those mentioned above. In addition, the mold parts 21 and 22 are configured so that inorganic particles which will be described later are stored in the cavity 25.

A pair of ladle support members 27 are attached to the upper surface of the mold part 21, and a ladle 28 filled with molten metal is rotatably supported by the ladle support members 27. By inclining the ladle 28, the molten metal in the ladle 28 is poured into the teeming port 26. The cavity 25 is opened to the lower surface of each of the mold parts 21 and 22 to thereby form an exhaust port 29.

In the joint surface 24 of the mold part 21, grooves 31 are formed at a distance of about 10 mm outside from the opposite sides of the portion defined as the cavity 25. Each of the grooves 31 has a semi-circular or rectangular section, and the width is about 6 to 10 mm. In addition, each groove 31 is opened to the teeming port 26 and the lower surface of the mold part 21. In addition, the grooves 31 may be provided in the mold part 22, or the grooves 31 may be formed in each of the mold parts 21 and 22.

A suction box 32 is attached to the lower surfaces of the mold parts 21 and 22 through a mesh member 33 formed of fiber matter having heat resistance and air permeability. The suction box 32 is urged upward by a not-shown air cylinder so as to be pressed against the lower surfaces of the mold parts 21 and 22. The mesh member 33 is formed of heat-resistant alumina fibers with gaps of 30 to 70 micron mesh.

The suction box 32 has a hollow rectangular parallelepiped shape. In the upper surface portion of the suction box 32, 10 cylindrical vent holes are aligned in opposition to an area including the cavity 25 and the grooves 31. Bent bushes 34 of iron are inserted into these vent holes respectively. Each of the bent bushes 34 has a shape like a cylindrical cup opening downward. Five or six slits parallel with each other are formed in the bottom surfaces of the bent bushes 34 (illustrated as a single hole 36 in FIGS. 5 and 6).

A suction port 35 is provided in the lower portion of the suction box 32. This suction port 35 is connected to a not-shown vacuum generation unit as a vacuum application means.

The operation of the apparatus for manufacturing a casting according to this second embodiment will be described below with reference to FIGS. 4 to 6.

First, the mold parts 21 and 22 are joined with each other as shown in FIG. 5, and the temperature of the mold parts 21 and 22 is kept within a range near the upper limit of solid-solution temperature of an aluminum alloy by the electric heaters 23. The suction box 32 is attached to the lower surfaces of the mold parts 21 and 22 through the mesh member 33, so that the lower end opening of the cavity 25 and the lower end openings of the grooves 31 are closed by the mesh member 33. Next, inorganic particles are introduced into the cavity 25 through the teeming port 26. Then, the vacuum generation unit is actuated to reduce the pressure in the cavity 25.

Successively, the ladle 28 is inclined to pour molten metal into the teeming port 26 (see FIG. 6). At this time, in a condition that the molten metal fills only the teeming port 26 but does not reach the cavity 25, the upper end openings of the cavity 25 and grooves 31 are closed by the molten metal in the teeming port 26. Therefore, the air existing in the cavity 25 and the grooves 31 is sucked by the vacuum generation unit through the suction box 32. Then, because the cavity 25 is filled with the inorganic particles, the flow path resistance of the molten metal in the grooves 31 is much smaller than that in the cavity 25. Therefore, first, the grooves 31 are filled with the molten metal. By the action of the mesh member 33, there is no fear that the molten metal flowing in the grooves 31 flows into the suction box 32.

The grooves 31 filled with the molten metal air-tightly block the cavity 25 from the outside of the mold parts 21 and 22 so as to attain sealing between the joint surfaces 24 of the mold parts 21 and 22 effectively. As a result, the vacuum in the cavity 25 is kept, so that the molten metal in the teeming port 26 is poured surely into fine gaps among particles in inorganic particle layers in the cavity 25. Then, the preset temperature of the mold parts 21 and 22 is changed to a range near the lower limit of the solid-solution temperature of an aluminum alloy to thereby solidify the molten metal poured into the fine gaps among the particles in the inorganic particle layers in the cavity 25. Next, the air cylinder is actuated to remove the suction box 32 from the lower surfaces of the mold parts 21 and 22. The mold parts 21 and 22 are opened, and a solidified composite member is released and taken out from the cavity 25.

Although molten metal is poured into the cavity 25 through the teeming port 26 after inorganic particles are introduced into the cavity 25 of the mold parts 21 and 22 in the second embodiment, an effect similar to that in the first embodiment can be obtained even in the case where the molten metal is poured into the cavity 25 through the teeming port 26 without introducing the inorganic particles into the cavity 25. In this case, the shape of the teeming port 26, and so on, are formed in the same manner as in the first embodiment.

Although such a suction casting method that a vacuum generation unit is connected to the suction port 15 or 35 of the suction box 12 or 32 so as to reduce the pressure in the cavity 5 or 25 is adopted in the above first or second embodiment, a low-pressure casting method in which positive pressure is applied into the cavity 5 or 25 through the teeming port 6 or 26 so as to pressurize and charge the molten metal into the cavity 5 or 25 in the mold by differential pressure of the atmosphere.

In the above first and second embodiments, the molten metal includes molten metal of copper, aluminum, magnesium, and an alloy thereof.

In the above first and second embodiments, the inorganic particles includes glassy porous particles (G-light; trade name), porous particles consisting of volcanic glassy sediment (Shirasuballoon; trade name), ceramics porous particles (Cerabeads; trade name), and so on.

The G-light is produced by crushing, heating, dissolving and foaming glass, and thereafter granulating the foamed glass. The thermal conductivity of these-glassy particles-is 0.06 Kcal/m.h/°C., which is smaller than that of silver sand. The specific heat of the glassy particles is large to be 0.3 to 0.41 cal/g.° C., and the particle size of the same is 0.5 to 1 mm. The specific gravity of the glassy particles is 0.3 to 0.5, which is lighter than that of silver sand. Further, this G-light has sufficient fire resistance as composite material combined with non-ferrous metal. In addition, if the G-light is used as the inorganic particles, waste glass can be recycled.

The above-mentioned Shirasuballoon is produced by rapidly heating and softening "Shirasu" (volcanic glassy sediment), foaming the softened "Shirasu" by the evaporative power of water of crystallization, and then granulating the foamed "Shirasu". The thermal conductivity of the Shirasuballoon is 0.05 to 0.09 Kcal/m.h/°C., which is smaller than that of silver sand. The specific heat of the Shirasuballoon is large to be 0.24 cal/g.°C., and the particle size of the same is 0.3 to 0.8 mm.

The specific gravity of this Shirasuballoon is 0.07 to 0.2, which is lighter than that of silver sand and the G-light.

INDUSTRIAL AVAILABILITY

According to the method of manufacturing a casting stated in Claim 1, when molten metal is introduced into a cavity defined by a mold split into at least two mold parts, a part of the molten metal to be introduced is introduced to the joint surfaces of the mold. The molten metal introduced to the joint surfaces air-tightly blocks the cavity in the mold from the outside of the mold. As a result, it is possible to attain the sealing between the joint surfaces of the mold effectively without using any packing material.

The apparatus for manufacturing a casting stated in Claim 2 has a groove which is formed in at least one of the respective joint surfaces of the two-part mold so as to extend around a defined portion of the cavity, and so as to be connected to an introduction port through which molten metal is introduced into the cavity. Accordingly, at the time of introducing the molten metal into the cavity, the cavity and the groove are closed by the molten metal in the introduction port in a condition that the molten metal fills only the introduction port while it does not reach the cavity. Therefore, the air existing in the cavity and the groove is exhausted out of an exhaust port surely. At this time, the groove filled with the molten metal air-tightly blocks the cavity from the outside of the mold. Accordingly, it is possible to effectively attain sealing between the joint surfaces of the mold.

According to the apparatus for manufacturing a casting stated in Claim 3, inorganic particles are charged into the cavity. Accordingly, the flow path resistance of the molten metal in the groove is much smaller than that in the cavity, so that the groove can be surely filled with the molten metal prior to the cavity when the molten metal is introduced into the introduction port.

According to the apparatus for manufacturing a casting stated in Claim 4, it is possible to manufacture a thin composite member.

According to the apparatus for manufacturing a casting stated in Claim 5, it is possible to prevent the molten metal flowing in the groove from flowing to the exhaust port.

We claim:

1. A method of manufacturing a casting comprising the steps of:

defining a cavity for manufacturing said casting by a mold split into at least two mold parts;

exhausting air in said cavity while introducing molten metal into said cavity; and forming sealing between respective joint surfaces of said mold parts by introducing a portion of said molten metal, which is introduced into said cavity, onto said joint surfaces substantially before said molten metal is introduced into said cavity.

2. An apparatus for manufacturing a casting comprising:

a mold split into at least two mold parts designed so as to define a cavity;

an introduction port provided at one end of said mold for introducing molten metal into said cavity;

an exhaust port provided at the other end of said mold for exhausting air in said cavity; and a groove which is provided around a portion defining said cavity in at least one of joint surfaces of said at least two mold parts said groove connecting said introduction port to said exhaust port; said groove out of direct communication with said cavity.

3. An apparatus for manufacturing a casting according to claim 2, wherein said mold split into at least two mold parts is configured for storing inorganic particles in said cavity.

4. An apparatus for manufacturing a casting according to claim 2, wherein a vacuum application means is connected to said exhaust port.

5. An apparatus for manufacturing a casting according to claim 2, wherein a heat-resistant mesh member is attached to said exhaust port.

6. An apparatus for manufacturing a casting according to claim 3, wherein a vacuum application means is connected to said exhaust port.

7. An apparatus for manufacturing a casting according to claim 3, wherein a heat-resistant mesh member is attached to said exhaust port.

8. An apparatus for manufacturing a casting according to claim 4, wherein a heat-resistant mesh member is attached to said exhaust port.

* * * * *

UNITED STATES PATENT AND TRADEMARK OFFICE

CERTIFICATE OF CORRECTION

PATENT NO. : 6,035,922
DATED : March 14, 2000
INVENTOR(S) : Nobuhiro Sugitani, Shoichi Makimoto It is certified that error appears in the above-identified patent and that said Letters Patent is hereby corrected as shown below:

Column 2,
Line 67, correct "A-A" to -- 2-2 --.

Column 3,
Line 1, correct "B-B" to -- 3-3 --.
Line 5, correct "C-C" to 5-5--.
Line 6, correct "D-D" to -- 6-6 --.
Line 17, correct "A-A" to -- 2-2 --.
Line 18, correct "B-B" to -- 3-3 --.

Column 4,
Line 60, correct "teeming port 5" to -- teeming port 6 --.

Column 5,
Line 7, correct "C-C" to -- 5-5 --.
Line 8, correct "D-D" to -- 6-6--.

Signed and Sealed this

Seventh Day of August, 2001

*Attest:*

Nicholas P. Godici

*Attesting Officer*

NICHOLAS P. GODICI
*Acting Director of the United States Patent and Trademark Office*